US005985059A

United States Patent [19]

Opalka et al.

[11] Patent Number: 5,985,059

[45] **Date of Patent: *Nov. 16, 1999**

[54] TRANSITION METAL SALT COMPOSITIONS THAT ELIMINATE HYDROGEN ABSORPTION AND ENHANCE HYDROGEN DEGASSING OF METAL AND METAL ALLOYS

[75] Inventors: Susanne M. Opalka, Pittsburgh; Joseph T. Laemmle, Delmont, both of Pa.

[73] Assignee: Aluminum Company of America, Pittsburgh, Pa.

[ * ] Notice: This patent is subject to a terminal disclaimer.

[21] Appl. No.: 09/040,013

[22] Filed: Mar. 17, 1998

Related U.S. Application Data

[63] Continuation-in-part of application No. 08/756,289, Nov. 25, 1996, Pat. No. 5,753,056.

[51] Int. Cl.[6] ..... C21D 1/68

[52] U.S. Cl. ..... 148/703; 148/713

[58] Field of Search ..... 148/703, 704, 148/711, 713

[56] References Cited

U.S. PATENT DOCUMENTS

| | | | |
|---|---|---|---|
| 2,885,313 | 5/1959 | Milliken | 148/6.27 |
| 2,885,315 | 5/1959 | Milliken | 148/13.1 |
| 2,885,316 | 5/1959 | Milliken | 148/13.1 |
| 4,391,655 | 7/1983 | Thurston et al. | 148/703 |
| 5,052,421 | 10/1991 | McMillen | 134/2 |
| 5,409,156 | 4/1995 | Tsuji et al. | 228/120 |
| 5,753,056 | 5/1998 | Opalka et al. | 148/703 |

FOREIGN PATENT DOCUMENTS

| | | |
|---|---|---|
| 0143715 | 5/1985 | European Pat. Off. . |
| 54-221286 | 2/1977 | Japan . |
| 54-36908 | 11/1979 | Japan . |

*Primary Examiner*—George Wysomierski
*Attorney, Agent, or Firm*—Tracey D. Beiriger

[57] ABSTRACT

A method of controlling bulk absorption of atomic hydrogen and facilitating degassing of hydrogen from a metal or metal alloy workpiece during heat treatments in furnaces with ambient and/or moisture-laden atmospheres, the method includes exposing the surface of the workpiece to an acidified inorganic salt solution or dispersion, with the inorganic salt of the solution containing a transition metal cation and a sulfate, phosphate or nitrate anion, before being subjected to said heat-treatment, said transition metal cation having an equal or positive standard reduction half-reaction potential relative to metal or metal alloy workpiece, the workpiece exposed to the acidified transition metal sulfate, phosphate or nitrate salt is subjected to a heat treatment. The acidified transition metal sulfate, phosphate or nitrate salt is used to substantially decrease the amount of atomic hydrogen entering the bulk of the workpiece during heat treatment and to facilitate removal of atomic and molecular hydrogen from the bulk of the metal or metal alloy workpiece.

12 Claims, No Drawings

TRANSITION METAL SALT COMPOSITIONS THAT ELIMINATE HYDROGEN ABSORPTION AND ENHANCE HYDROGEN DEGASSING OF METAL AND METAL ALLOYS

This application is a continuation-in-part of U.S. patent application Ser. No. 08/756,289, filed Nov. 25, 1996 now U.S. Pat. No. 5,753,056.

BACKGROUND OF THE INVENTION

The present invention relates generally to the problem of metal and metal alloy workpieces absorbing hydrogen when undergoing heat treatment in furnaces containing ambient moisture-laden atmospheres, and particularly to transition metal salt compositions that substantially reduce the absorption of hydrogen into such workpieces and, in addition, greatly enhances hydrogen degassing of such workpieces. The control of bulk hydrogen levels can be critical to the mechanical reliability of products fabricated from commercially significant metals or alloys, containing aluminum, nickel, tantalum, titanium, copper, iron, zirconium and magnesium.

When a metal or metal alloy object is heated in the presence of moist air, a protective oxide layer on the object is invariably disrupted to expose nascent metal. Aluminum oxidation in the presence of water, for example, while in a heated furnace, generates atomic hydrogen, which readily diffuses into the aluminum object, and is the only gas that has appreciable solubility in aluminum. Still, atomic hydrogen has limited solubility in metal and has the propensity to precipitate in the metal as insoluble molecular hydrogen ($H_2$) at heterogeneities or defects, especially in highly worked regions within the metal object. As increasing hydrogen is precipitated and trapped within the metal, additional hydrogen can be absorbed and solubilized within the metal matrix. Bulk porosity in a metal workpiece, including porosity that is induced or enhanced by precipitated molecular hydrogen, can compromise structural integrity and the mechanical performance of the final metal parts.

For several decades, ammonium fluoborate ($NH_4BF_4$) protective atmospheres have been used in the industry to prevent substantial absorption of hydrogen by aluminum alloy workpieces during high temperature furnace treatments. Ammonium fluoborate decomposes during such treatments at temperatures above 482° F. to form a blanket atmosphere that fills the entire internal volume of a furnace. Ammonium fluoborate also produces an array of compounds in the furnace which can eliminate high temperature oxidation reactions by either reacting with ambient water or by forming a protective fluorinated layer on the aluminum alloy workpiece.

There are drawbacks to the use of ammonium fluoborate atmospheres, however. Ammonium fluoborate species can stain and pit surfaces of some aluminum alloys. The ammonium fluoborate decomposition products contain toxic, corrosive and particulate species. The ammonium fluoborate emissions corrode furnace structures and baghouses for filtering particulate emissions. Disposal of the collected particulates is costly. Concerns relating to the emissions have prompted research to identify alternative chemistries that are more environmentally friendly and safer for in-plant use.

BRIEF SUMMARY OF THE INVENTION

The present invention employs an acidified inorganic transition metal salt treatment composition (solution or dispersion) containing a transition metal cation and a sulfate, phosphate or nitrate anion and 0.01 to 5 wt. % hydrochloric acid, with the transition metal cation of the metal salt having an equal or positive standard reduction half-reaction potential relative to that of the metal or of the predominant metal species of the alloy to be treated. Such a composition eliminates hydrogen absorption and enhances hydrogen degassing of metal and metal alloy workpieces in heat treating furnaces containing moist atmosphere when applied before heat treatment. Chlorine and particulate emissions from aluminum parts treated with the composition in furnaces at elevated temperatures is substantially reduced, compared to the fluoride and particulate emissions from furnace practices with ammonium fluoborate atmospheres. The elimination of particulates, of course, eliminates the need and cost of baghouses and landfill sites for the particulates.

The subject treatment can be applied to workpieces by dipping, spraying, roller coating or other techniques without subsequent rinsing, prior to heat treatment, with a minimum exposure time of five seconds. During subsequent heat treatments, atomic hydrogen at the metal workpiece surface is converted into chemistries insoluble in the metal matrix. Such a reaction pathway consumes any hydrogen generated by high temperature oxidation reactions at the workpiece surface or outgassed from the bulk of the workpiece. Similar reaction mechanisms with aluminum and/or magnesium metal, metal oxides and/or metal hydroxides have been found to be favorable in this regard. The salt products of aluminum or magnesium ultimately decompose to form oxide/hydroxide phases, releasing the corresponding conjugate acids. In this manner, aluminum oxidation/hydroxylation can occur without additional generation of atomic hydrogen.

In the compositions of the invention, the most effective transition metal cations are iron, copper and nickel, for metal or metal alloys, where the predominant metal species has an equal or lesser standard reduction, half reaction potential. The effective concentration range of the transition metal salts has been found to be about 0.05 to 47 wt. % salt, or more preferably between about 5–10 wt. % salt, per total weight of solution or dispersion employed, when water is employed as the solvent carrier. The solution or dispersion is acidified with hydrochloric acid, in a range of 0.01 to 5 percent of the solution, to locally dissolve oxides and facilitate direct oxidation-reduction reactions with the metallic species. Transition metal salts have varying solubility characteristics, such that a solvent carrier is chosen to provide adequate solubility or dispersibility of the transition metal salt employed.

PREFERRED EMBODIMENTS

It has been found that a 10 wt. % ferric sulfate aqueous solution acidified with 0.3 wt. % hydrochloric acid is particularly effective in preventing absorption of atomic hydrogen and in degassing hydrogen from the bulk of an aluminum alloy workpiece during furnace treatments in moist atmospheres, though a concentration range of a transition metal sulfate, phosphate or nitrate salt of 0.05 to 47.0 percent of the total weight of an aqueous solution or dispersion provides the benefits described herein. The pH of the solution/dispersion can range between 0.1 to 2.5. Appropriate carriers, other than water, may be isopropanol or a low molecular weight, non-aromatic hydrocarbon.

The chemistry disclosed herein is also applicable to metals other than aluminum that are also absorbers of hydrogen. These metals include nickel, tantalum, titanium, copper, iron, zirconium and magnesium.

Similarly, a two to ten percent ferrous sulfate solution with 0.3 wt. % hydrochloric acid was found to be extremely effective in limiting hydrogen absorption and increasing hydrogen removal. In using the 0.3 wt. % hydrochloric acid composition, specimens of the aluminum, after heat treatment in a water-saturated atmosphere, consistently had hydrogen levels at less than one-half of unheated ingot. Ten weight percent (10 wt. %) ferric sulfate alone or 10 wt. % ferric sulfate acidified with sulfuric acid were not as effective in reducing hydrogen contents during identical heat treatments. Untreated aluminum samples heated under identical furnace conditions, consistently had hydrogen levels three times that of unheated samples.

The following example and Table 1 show that the efficacy of an initial dip treatment in an aqueous ferric sulfate solution acidified with hydrochloric acid, in both providing protection against pickup of atomic hydrogen and facilitating hydrogen extraction in aluminum alloy parts, during heat treatment in a water-saturated atmosphere. At least fifty percent of the initial hydrogen content was extracted (the lower reliable detection limit for hydrogen determination by inert gas fusion analysis technique is 0.05 ppm) during the heat treatment with the ferric sulfate/hydrochloric acid solution deposited on the aluminum surface. When identical parts of the same aluminum alloy stock were heated under the same conditions without the application of the above ferric sulfate solution, the hydrogen accumulated within the bulk of the stock increased three times that of the original content prior to heat treatment. The results show that the initial dip treatment in an aqueous solution with the same level of ferric sulfate, but without hydrochloric acid, afforded only limited protection against pickup of atomic hydrogen during heat treatment of identical aluminum alloy parts under the same heat treatment conditions. Even less protection against pickup of atomic hydrogen was provided during heat treatment of identical aluminum alloy parts under the same conditions, following an initial dip treatment in an aqueous ferric sulfate solution acidified with sulfuric acid.

TABLE 1

Change in Aluminum Alloy Hydrogen Level with Dip Treatments and Heat Treatments

| Treatment Chemistry 60 second dip in aqueous solution containing: | Heat Treatment- 10 hour soak at 850° F, in water-saturated atmosphere | Ave. Hydrogen Content (ppm) in Al Alloy bulk-determined by inert gas fusion analyses |
|---|---|---|
| Not conducted (control stock) | Not conducted | 0.10 ± 0.02 (12 samples) |
| 10% $Fe_2(SO_4)_3$, 0.3% HCl | Conducted | 0.05 ± 0.01 (9 samples) |
| Not conducted (control stock) | Conducted | 0.30 ± 0.03 (9 samples) |
| 10% $Fe_2(SO_4)_3$ | Conducted | 0.13 (3 samples) |
| 10% $Fe_2(SO_4)_3$, 2% $H_2SO_4$ | Conducted | 0.22 (3 samples) |

In using the invention, surfaces of a workpiece can be dipped, coated or sprayed with the solution or dispersion of the invention, and then heated in a furnace with an ambient moist atmosphere, without wiping or rinsing the surfaces of the workpiece before placement in the furnace.

In addition to the compositions of the above solutions or dispersions, certain additional agents can be incorporated in the compositions. There may be a need to use dispersants to suspend insoluble transition metal salts in the solvent carrier. There is sometimes the need to use a solvent-based formulation to aid in drying or wetting of workpiece surfaces, using solvents such as alcohol, glycols, glycol ether acetates and low molecular weight hydrocarbons. Surfactant species may be incorporated to improve the formulation wetting on workpiece surfaces and to ensure a more uniform surface reaction.

If the surface of a workpiece is particularly dirty or oily, the surface can be prepared before dipping by cleaning with a solvent or degreasing agent. In addition, the surface can be prepared by an alkaline etch followed by a deionized water rinse, followed by the application of an acidic desmutting solution followed by a deionized water rinse.

What is claimed is:

1. A method of controlling bulk absorption of atomic hydrogen and facilitating degassing of hydrogen from a metal or metal alloy workpiece during heat treatments in furnaces with ambient and/or moisture-laden atmospheres, the method comprising:

exposing the surface of said workpiece to an inorganic salt solution or dispersion acidified with hydrochloric acid, with the inorganic salt of the solution containing a transition metal cation and a sulfate, phosphate or nitrate anion, before being subjected to said heat-treatment, said transition metal cation having an equal or positive standard reduction half-reaction potential relative to metal or metal alloy workpiece;

subjecting said workpiece exposed to said hydrochloric acidified transition metal sulfate, phosphate or nitrate salt solution or dispersion to a heat treatment; and using the hydrochloric acidified transition metal sulfate, phosphate or nitrate salt solution or dispersion to substantially decrease the amount of atomic hydrogen entering the bulk of the workpiece during heat treatment and to facilitate removal of atomic and molecular hydrogen from the bulk of the aluminum alloy workpiece.

2. The method of claim 1 wherein the hydrochloric acid is in the amount lying in the range of 0.01 to 5 percent of the solution or dispersion.

3. The method of claim 1 in which the solution or dispersion is a solvent comprised predominantly of water.

4. The method of claim 1 in which the inorganic salt is a transition metal sulfate, phosphate or nitrate salt having a concentration in the range of 0.05 to 47.0 percent of the total weight of the solution or dispersion.

5. The method in claim 4 in which the inorganic salt is ferric or ferrous sulfate, having a concentration in the range of two to ten percent of the total weight of the solution or dispersion.

6. The method of claim 1 wherein the pH of solution or dispersion ranges between 0.1 and 2.5.

7. The method of claim 1 wherein the metal or metal alloy workpiece is exposed to the solution for a minimum exposure time of five seconds and the solution is applied by dipping, coating or spraying onto the workpiece.

8. The method of claim 1 wherein the surface of the metal or metal alloy workpiece exposed to the acidified inorganic salt solution or dispersion is subjected to the heat treatment without wiping or rinsing the workpiece surface prior to such heat treatment.

9. The method of claim 1 wherein the metal or metal alloy workpiece is subjected to cleaning or degreasing with a solvent or alkaline etch followed by a deionized water rinse and/or an acidic desmutting step, followed by a deionized water rinse, prior to treatment with the acidified inorganic salt solution or dispersion.

10. The method of claim 1 wherein a wetting agent or dispersant is incorporated in the acidified inorganic salt solution or dispersion to facilitate uniform treatment of metal or metal alloy workpiece.

11. The method of claim 1 wherein a solvent-based formulation is added to the acidified inorganic salt solution or dispersion to aid drying or wetting the metal or metal alloy workpiece surface before the workpiece is subjected to heat treatment.

12. The method of claim 11 wherein the solvent of the added solvent-based formulation is selected from the group consisting essentially of alcohols, glycols, and glycolether acetates and low molecular weight, nonaromatic hydrocarbons.

* * * * *